US006536310B2

(12) United States Patent
Goldfein

(10) Patent No.: US 6,536,310 B2
(45) Date of Patent: Mar. 25, 2003

(54) LOW-PROFILE WRENCH

(76) Inventor: Nathan Goldfein, P.O. Box 36111, Phoenix, AZ (US) 85067

( * ) Notice: Subject to any disclaimer, the term of this patent is extended or adjusted under 35 U.S.C. 154(b) by 0 days.

(21) Appl. No.: 09/892,219

(22) Filed: Jun. 25, 2001

(65) Prior Publication Data

US 2002/0017168 A1 Feb. 14, 2002

Related U.S. Application Data

(63) Continuation-in-part of application No. 09/638,417, filed on Aug. 14, 2000, now abandoned.

(51) Int. Cl.[7] ..... B25B 17/00
(52) U.S. Cl. ..... 81/57.29; 81/57.13; 81/185
(58) Field of Search ..... 81/57.13, 57.12, 81/57.28, 57.29, 169, 170, 185

(56) References Cited

U.S. PATENT DOCUMENTS 3,875,829 A * 4/1975 Evans et al. ..... 81/185
4,003,275 A * 1/1977 Smith ..... 81/57.29
4,027,558 A * 6/1977 Fish ..... 81/185 X
4,242,931 A * 1/1981 Clement ..... 81/57.29
4,517,861 A * 5/1985 Stemberger ..... 81/57.29
4,813,308 A * 3/1989 Petrus ..... 81/57.29
4,840,094 A * 6/1989 Macor ..... 81/185
5,345,845 A * 9/1994 Myers ..... 81/57.29
5,584,220 A * 12/1996 Darrah et al. ..... 81/57.29
5,630,343 A * 5/1997 Begin ..... 81/57.29 X
5,709,136 A * 1/1998 Frenkel ..... 81/57.29 X
6,116,121 A * 9/2000 Kitt ..... 81/170

* cited by examiner

*Primary Examiner*—James G. Smith
(74) *Attorney, Agent, or Firm*—Birdwell, Janke & Durando, PLLC

(57) ABSTRACT

A low-profile wrench. An elongate, axially asymmetric housing encloses two turning members have axes of rotation that are angled with respect to one another. One of the turning members, whose axis is oriented in the elongate dimension of the housing, receives a turning force and transmits the turning force to the other turning member. The second turning member is adapted to be coupled to a fastener, for turning the fastener.

14 Claims, 6 Drawing Sheets

LOW-PROFILE WRENCH

This is a continuation-in-part of application Ser. No. 09/638,417 filed Aug. 14, 2000, now abandoned.

BACKGROUND OF THE INVENTION

The present invention relates to a low-profile wrench, particularly a low-profile wrench that is adapted for use with a powered driver mechanism.

A common problem for designers of mechanical equipment employing bolts, nuts, screws or other such rotational fasteners is providing sufficient space around the fasteners to permit a wrench and its required range of motion to fit. Conversely, mechanics charged with installing or removing the fasteners have the problem of fitting the tool into the space provided.

Air or electric powered wrenches provide the advantage of reducing the range of motion required for operating a wrench that must otherwise be turned by hand as well as reducing effort and increasing speed; however, such wrenches are generally bulky and are difficult or impossible to use in tight quarters. They also exert considerable torque so that a firm grip is needed to use them.

Some wrench designs have been disclosed that may facilitate access to fasteners in tight quarters and provide for the use of a powered wrench. For example, the wrench disclosed in Frenkel, U.S. Pat. No. 5,709,136, employs a rack-and-pinion type gear drive to alter the direction of torque by 90 degrees and thereby permit access to tight quarters. However, the rotatable drive shaft of the Frenkel wrench must be laterally offset from the plane of the companion gear, as shown in FIG. 4 of Frenkel, which requires additional lateral space and thereby imposes a limitation on the degree to which the width of the wrench can be minimized. Begin, U.S. Pat. No. 5,630,343 employs a worm shaft and worm drive in a power driven socket wrench that reduces the required width of the wrench; however, the Begin wrench can be used only for a male coupling feature such as a square drive. Such a male coupling feature necessarily limits the degree to which the width of the wrench can be minimized.

Especially where a female coupling feature is used, such as in the Frenkel wrench, and also where a male coupling feature that is not a standardized drive element is used, there is the additional problem of employing the wrench for a variety of different shapes and sizes of fastener. This requires a corresponding variety of sizes and shapes for the bit. In that regard, the Frenkel wrench provides for removing a socket head that includes the rack gear portion of the rack-and-pinion drive and the bearings for rotationally supporting the rack gear, as well as the bit used for coupling to the fastener. Accordingly, to replace the bit requires replacing all of these other parts as well, and providing interchangeable parts requires providing a plurality of relatively expensive and bulky parts.

Accordingly, there is a need for a low-profile wrench that minimizes the width thereof to permit use in limited space and that preferably facilitates the use of an air or electric powered wrench, and that also facilitates and makes more economical the use of the wrench with a variety of different sizes and shapes of fastener.

SUMMARY OF THE INVENTION

The low-profile wrench of the present invention solves the aforementioned problems and meets the aforementioned need by providing a wrench comprising an elongate, radially asymmetric housing that encloses two turning members having axes of rotation that are angled with respect to one another and facilitates gripping so that the wrench does not rotate in the user's hand. One of the turning members has an axis of rotation oriented in the elongate dimension of the wrench and receives the turning force. It transmits the turning force to the other turning member, which is oriented in a narrow dimension of the wrench and is adapted to be coupled to a fastener, thereby converting torque from an elongate direction to a lateral direction for turning the fastener. Preferably, the turning force is provided by a motor, such as an electric or pneumatic motor, though this is not essential.

In one aspect of the invention, a housing is provided for substantially enclosing the turning members, wherein the housing has a height that is substantially greater than its width.

In another aspect of the invention, one of the turning members receives the turning force at an input thereof, the input being provided in the form of a knob adapted for turning by the fingers, for indexing the other turning member to match the orientation of the fastener. In conjunction, the housing provides for a partial enclosure of this knob to protect it from damage while also providing manipulative access to the knob.

In still another aspect of the invention, the turning members comprise a worm shaft and a worm gear, the worm gear including a throughport defining a coupling feature for coupling to the fastener. Preferably, the throughport is adapted to receive an interchangeable insert.

In yet another aspect of the invention, the worm gear has a recess on a lateral face thereof for receiving a bearing for rotationally supporting the worm gear.

In still another aspect of the invention, the turning members comprise a worm shaft and a worm gear, the worm gear including a recess on a lateral face thereof for receiving a bearing for rotationally supporting the worm gear and is adapted to receive an interchangeable insert.

In a further aspect of the invention, one of the turning members includes a port through the turning member for receiving an interchangeable insert.

Therefore, it is a principal object of the present invention to provide a novel and improved low-profile wrench.

It is another object of the present invention to provide a low-profile wrench that may be used in limited space.

It is still another object of the present invention to provide such a low-profile wrench that facilitates powered operation.

It is yet another object of the present invention to provide a low-profile wrench that facilitates use of the wrench with a variety of different sizes and shapes of fastener.

It is a further object of the present invention to provide a low-profile wrench that economizes use of the wrench with a variety of different sizes and shapes of fastener.

The foregoing and other objects, features and advantages of the present invention will be more readily understood upon consideration of the following detailed description of the invention, taken in conjunction with the following drawings.

DETAILED DESCRIPTION OF A PREFERRED EMBODIMENT

Figure 1:
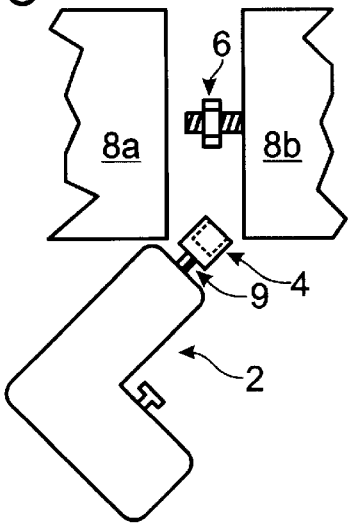
Fig. 1 (PRIOR ART)
FIG. 1 illustrates a prior art power wrench driver and socket and a fastener in tight quarters.

Referring to FIG. 1, a prior art powered driver 2 with standard square drive 9 and socket 4 is shown for purposes of illustrating a problem. As illustrated, there is insufficient space between the objects 8*a* and 8*b* to maneuver the wrench into the space and fit the socket over the fastener. A standard open end wrench may be used in such a circumstance; however, there may be additional obstructions that prevent the user from being able to turn the wrench through a sufficient length of arc. In any event, it is generally preferable to be able to remove or tighten fasteners without resorting to muscle power.

Figure 2:
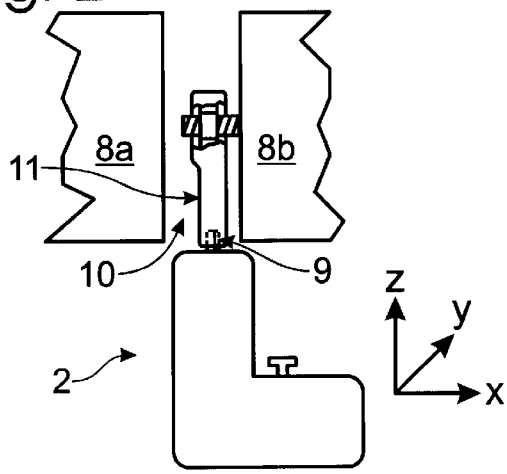
FIG. 2 is a top view of a first embodiment of a low-profile wrench according to the present invention, used in conjunction with a powered wrench, for turning the fastener of FIG. 1.

Turning to FIG. 2, a device according to the present invention is shown that solves the problem posed in FIG. 1. As shown therein, this first embodiment is generally elongate in the "z" dimension and has one lateral, "x" dimension that is narrower than the other, orthogonal, "y" dimension perpendicular to the figure. In this case, wrench driver 2 is coupled to the low-profile wrench 10 instead of the socket 4. The low-profile wrench has a housing 11 that preferably encloses one of two alternative torque-converter mechanisms described below, or their equivalents, and is shaped to facilitate gripping without slippage or rotation in the user's hand. Though a specific fastener is used for illustration of a preferred embodiment of the invention, it should be understood that the wrench 10 may be used for turning any type of rotational fastener, including nuts, bolts and screws, in any variation or style.

Figure 3:
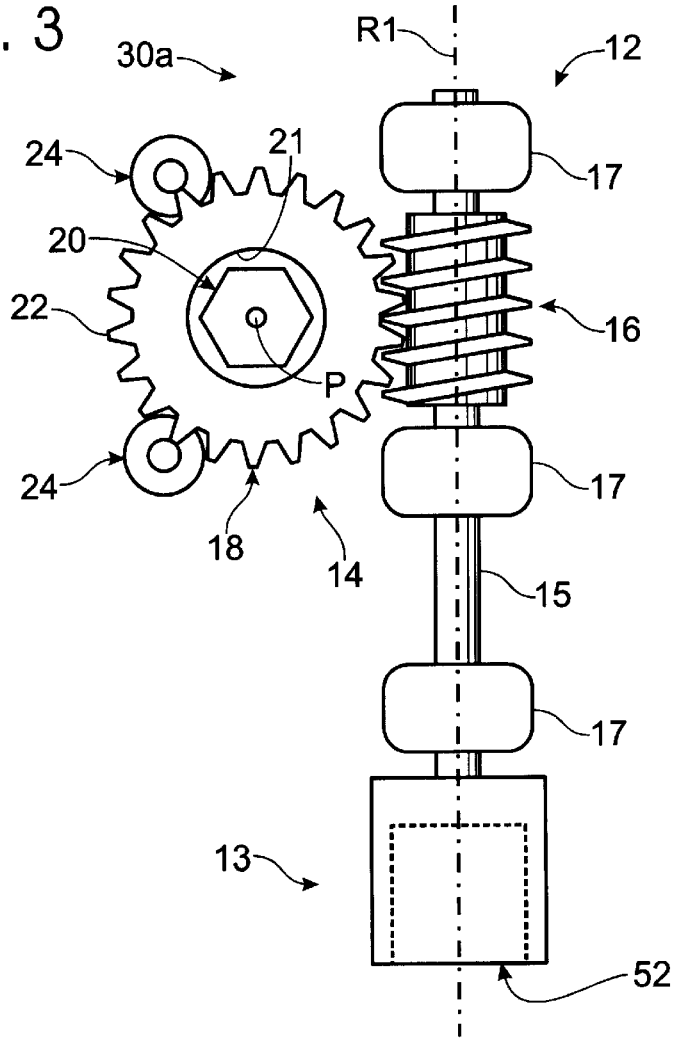
FIG. 3 is a front view of a first embodiment of a torque-converter mechanism for a low-profile wrench according to the present invention.
Figure 4:
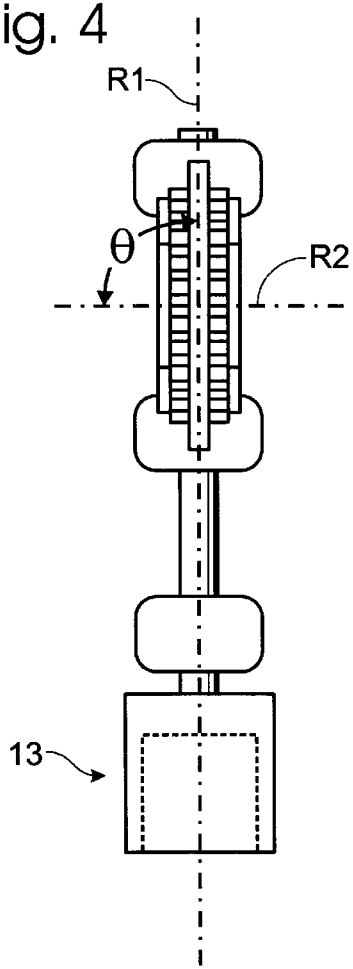
FIG. 4 is a side elevation of the embodiment of FIG. 3.

One of two preferred torque-converter mechanisms for use in the wrench 10 is shown in FIGS. 3 and 4. In this case torque-converter mechanism 30*a* includes two turning members 12 and 14. The turning member 12 receives a turning force and, in response, turns about a first axis of rotation R1. The turning force is preferably applied at input 13 by powered rotating means (hereinafter "motor") such as the driver 2 (FIGS. 1 and 2), which may be electric or pneumatic; however, the turning force may be applied by hand without departing from the principles of the invention. The wrench 10 is illustrated with a standard square recess 52 for the input 13 for coupling to the standard square drive 9 that is typical of socket drivers; however, other coupling mechanisms for receiving the turning force may be employed where desired.

The turning member 12 transmits the turning force received at the input 13 to the turning member 14. In the particular embodiment shown in FIGS. 1 and 2, this is through a worm 16 of the member 12 ("worm shaft") that meshes with complementary gear teeth 18 on the member 14 ("worm gear"). However, it should be understood that any means for mechanically coupling the turning force from the member 12 to the member 14 may be employed. For example, though it may not work as well, the turning member 12 may transmit the turning force via frictional engagement with the turning member 14.

Referring to FIG. 4, the turning member 14 turns about a second axis of rotation R2 that is angled with respect to the axis R1. Preferably, the second axis R2 is perpendicular to axis R1, though any other non-zero angle Θ may be employed without departing from the principles of the invention. In general, the closer the angle Θ is to 90 degrees, the more compact the wrench will be, with a zero angle Θ providing no advantage over use of the turning member 12 to transmit the turning force to the fastener directly.

The turning member 14 is provided with a coupling feature 20 that is adapted to couple to the fastener. The coupling feature shown is a hexagonal shaped aperture or port therethrough ("throughport") adapted to fit over the head of a hexagonal nut or bolt-head. Of course, any other feature that is adapted to couple to the fastener for the purpose of turning the fastener may be employed. The coupling feature 20 may be in female form, such as the throughport, or in male form such as a bit or socket drive.

The coupling feature 20 is located within the interior portion of the member 14 and, typically, is rotationally symmetric about a center point P that lies precisely on the axis of rotation R2; however, this coincidence is not necessarily a requirement for turning the fastener. For example, where the coupling feature is the blade of a screwdriver and the fastener is a slotted screw, the screw may be turned by the blade even though the blade is somewhat off-center with respect to the point P.

To provide space for the coupling feature 20, one or more turning members 24 for constraining the second member 14 to rotate about the axis R2 are provided at the periphery 22 of the member. Here, the turning member 14 is a gear and includes gear teeth at the periphery, and the members 24 are also preferably gears including gear teeth that mesh with the gear teeth of the member 14. The members 24 may alternatively be, for example, rollers, wheels or low friction non-rotating members that permit sliding on their surfaces.

The above described worm and worm gear torque-converter mechanism for the wrench 10 is particularly advantageous in minimizing its profile or the width of the wrench in the direction of the axis "R2." This is because the center of the worm shaft, i.e., the member 12, is coplanar with the center of the worm gear, i.e., member 14, and may be located equidistant from the sides of the wrench. When combined with the throughport coupling feature 20 and recessed bearings 62*a* and 62*b* described below, minimal wrench width may be achieved.

Figure 6:
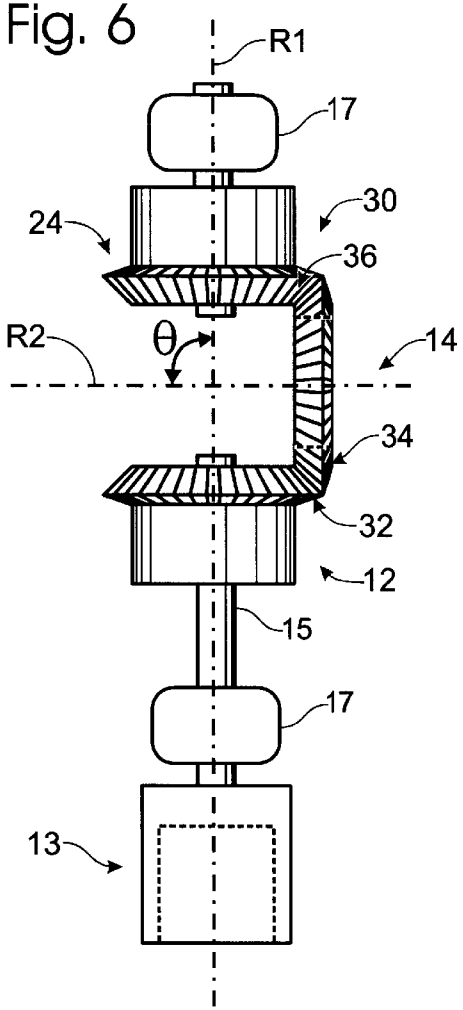
FIG. 6 is a side elevation of the embodiment of FIG. 5.
Figure 5:
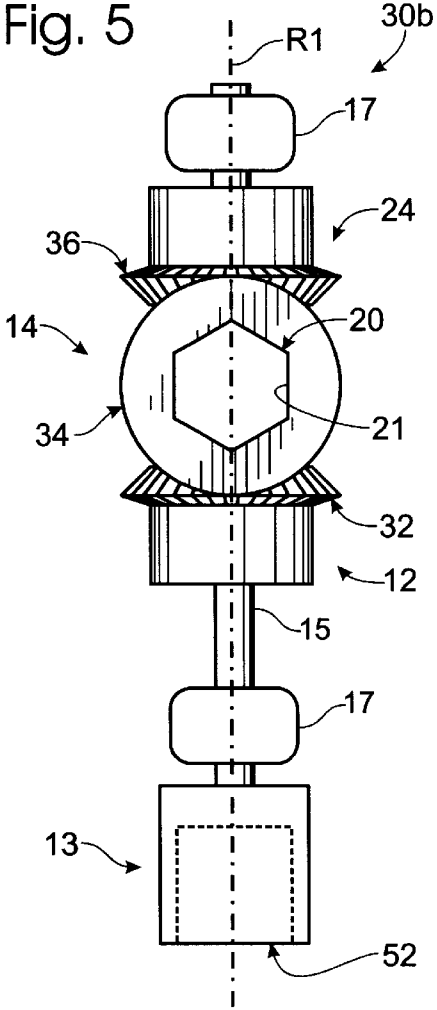
FIG. 5 is a front view of a second embodiment of a torque-converter mechanism for a low-profile wrench according to the present invention.

FIGS. 5 and 6 show a second alternative embodiment 30*b* of a torque-converter mechanism to be enclosed by the housing 11 according to the present invention. The turning member 12 includes, instead of the worm 16, a miter gear 32, wherein the turning member 14 includes a corresponding miter gear 34. In the Figures, the miter gears are shown with respect to axes of rotation R1 and R2 (as described above) at an angle Θ of 90 degrees; however, it should be understood that other angles may be employed. As for the wrench 10, one or more turning members 24 for constraining the second member 14 to rotate about the axis R2 are provided at the periphery 22 of the member. For example, a single free-wheeling third miter gear 36, mitered in the same fashion as the gear 32, may be employed.

Figure 7:
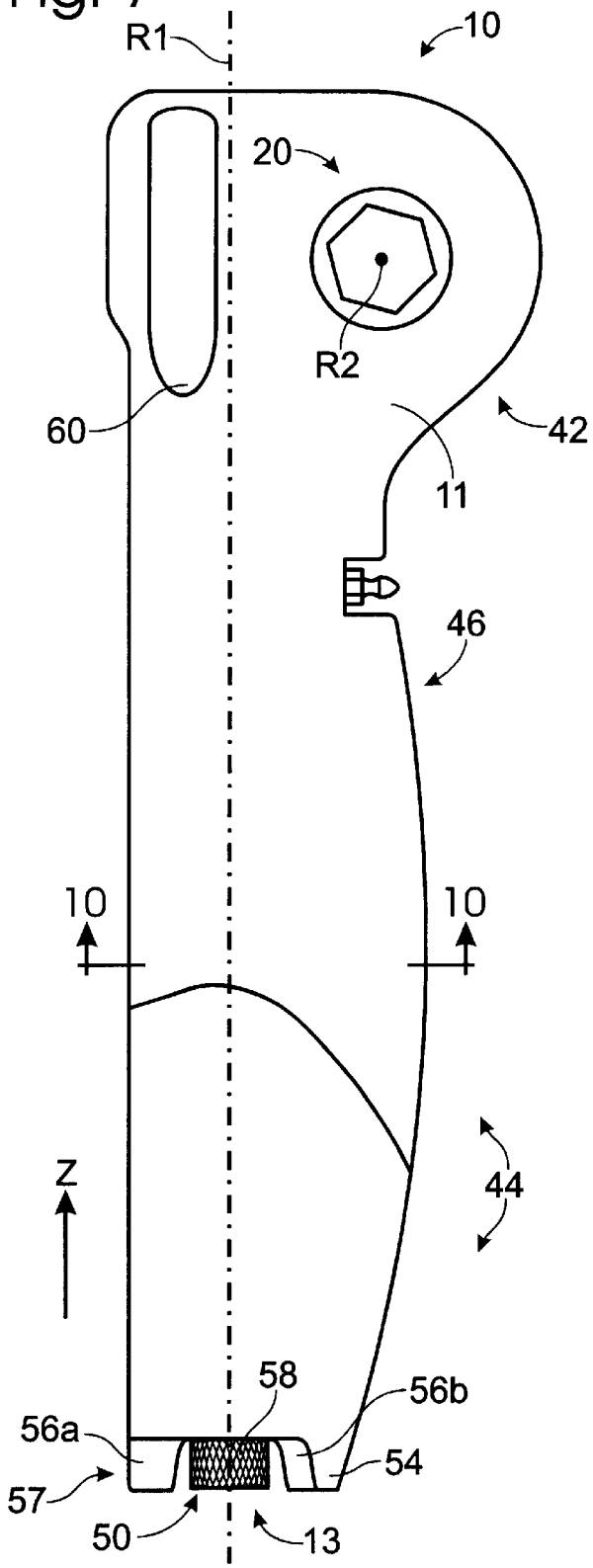
FIG. 7 is a side view of a second embodiment of a low-profile wrench according to the present invention.
Figure 8:
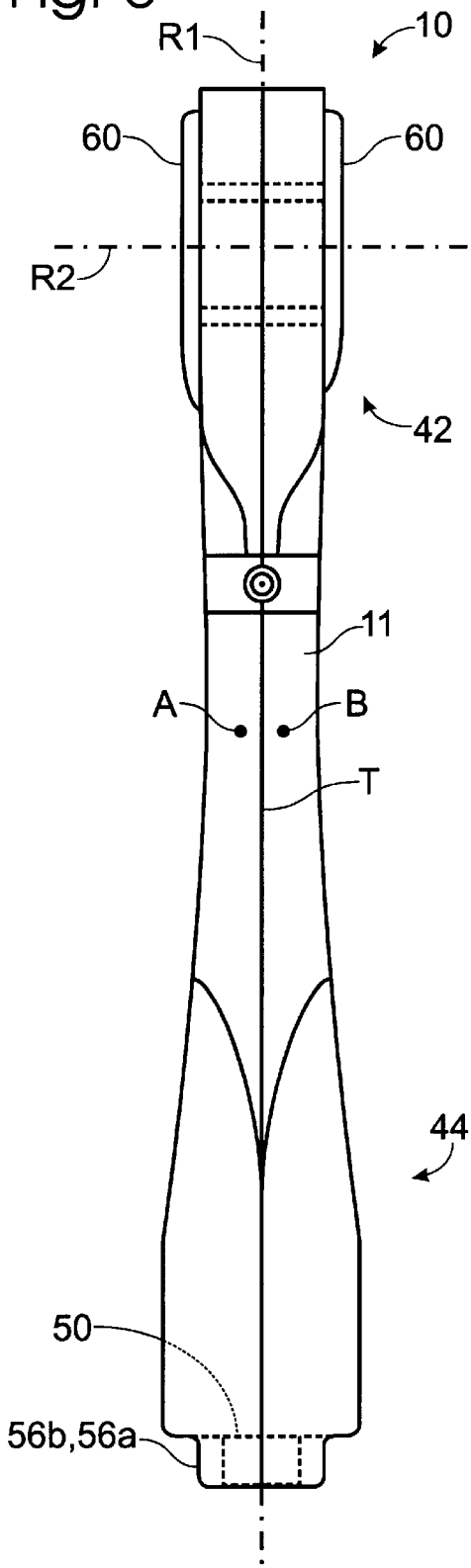
FIG. 8 is a top view of the wrench of FIG. 7.
Figure 9:
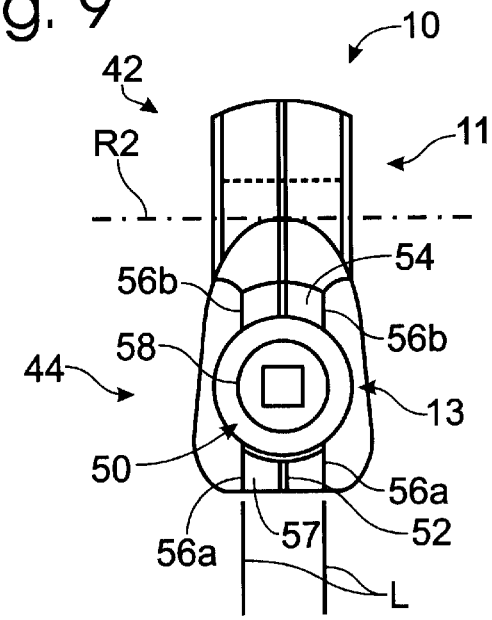
FIG. 9 is an end view of the wrench of FIG. 7.
Figure 10:
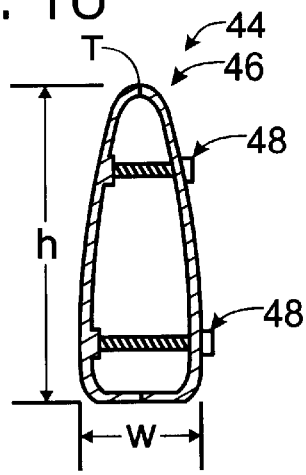
FIG. 10 is a section view of the wrench of FIG. 7, taken along a line 10—10 thereof
Figure 11:
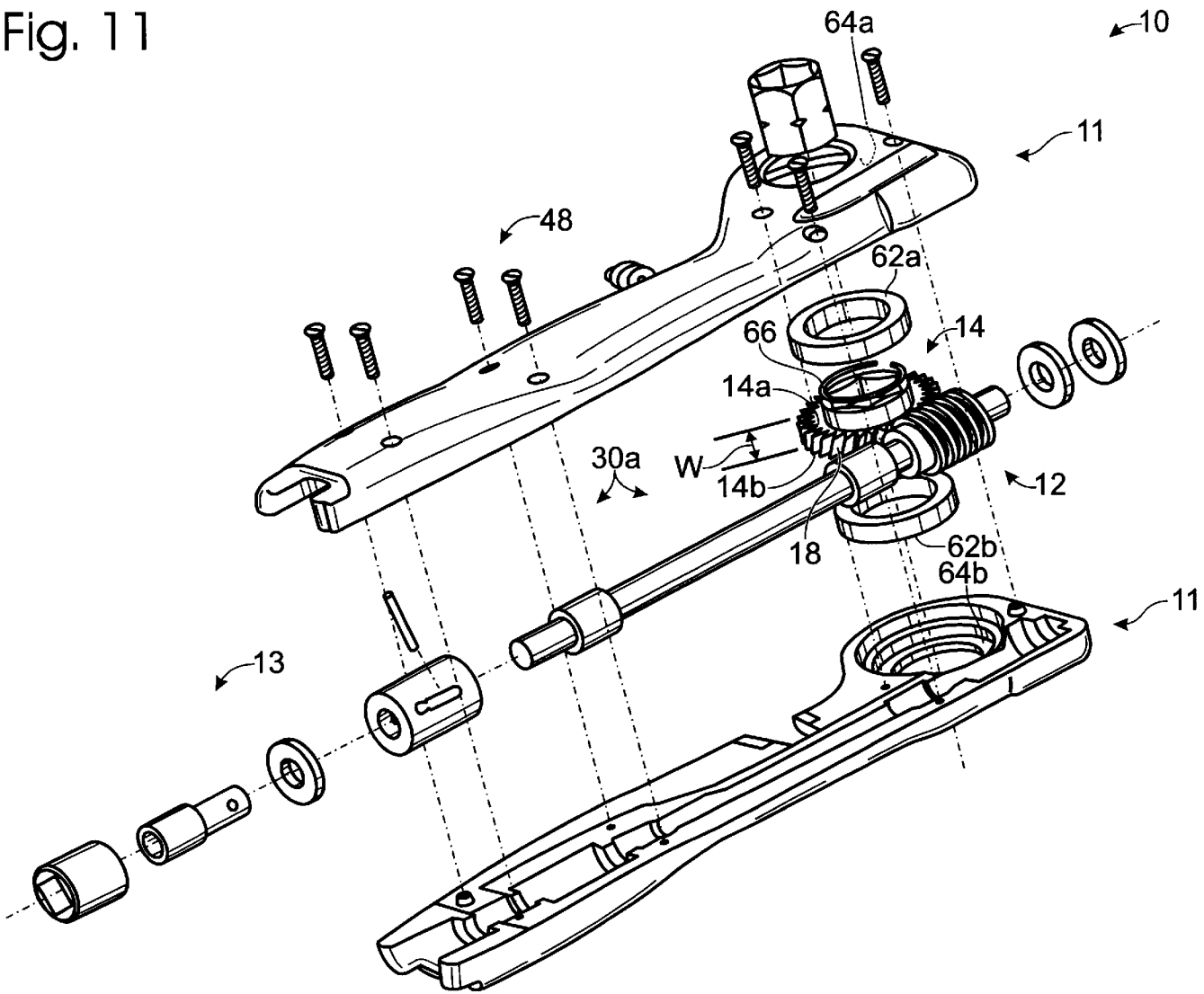
FIG. 11 is a pictorial exploded view of the wrench of FIG. 7 showing a two-part housing and, by way of example, the torque-converter mechanism of FIG. 3 enclosed thereby.

A second, preferred embodiment of the low-profile wrench 10 according to the present invention is shown in FIGS. 7 and 8, particularly. This embodiment is distinguished by the shape of the housing 11, which may contain either of the torque-converter mechanisms 30*a* or 30*b*. FIGS. 9 and 10 show end and section views, respectively, of this preferred embodiment of the wrench, and FIG. 11 shows an exploded view of the wrench enclosing, for example, a torque-converter mechanism similar to that of FIGS. 3 and 4. The housing 11 of the low-profile wrench provides outstanding comfort and ease of manipulating the wrench in limited space, particularly when used with an air or electric powered wrench.

The wrench 10 has a ratchet end 42 containing the aforementioned coupling feature 20, and a handle end 44 for gripping the wrench mechanism by hand for operating the mechanism, the input 13 of the enclosed torque-converter mechanism extending from the handle end 44 along the axis R1.

When the wrench 10 is being used, for example to tighten a bolt-head, torque about the axis R1 provided at the input 13 is transmitted through the coupling feature 20 to the bolt-head, thereby producing torque about the axis R2. However, the bolt-head resists turning, and the wrench itself reacts to the torque about the axis R1 by twisting about this axis. Since some play between the coupling feature 20 and, e.g., the bolt-head is intentionally provided to permit easy application of the wrench, the wrench can twist as a result of this reaction. This twisting can damage the wrench and the objects 8 (FIG. 2), and possibly injure the user of the tool.

To address this problem, the handle end 44 is provided according to the invention so that it has a height "h" that is greater than its width "w," as can best be seen with reference to FIG. 10. In the preferred embodiment of the invention, the height is about twice the width.

Figure 12:
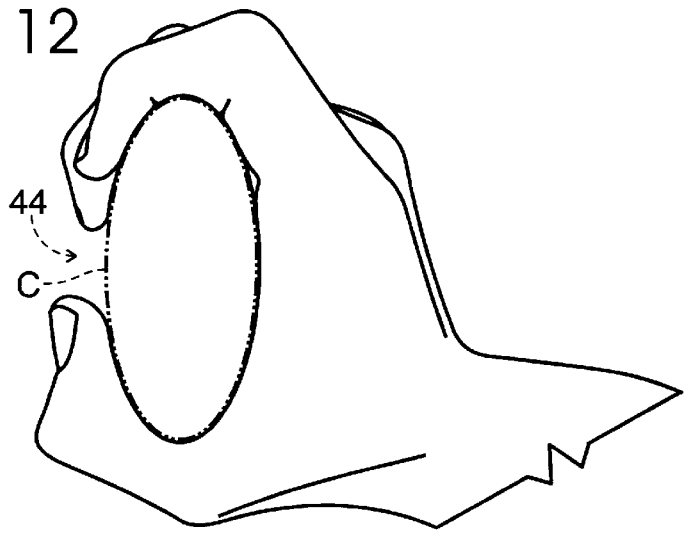
FIG. 12 illustrates a hand gripping the wrench of FIG. 7.
Figure 13:
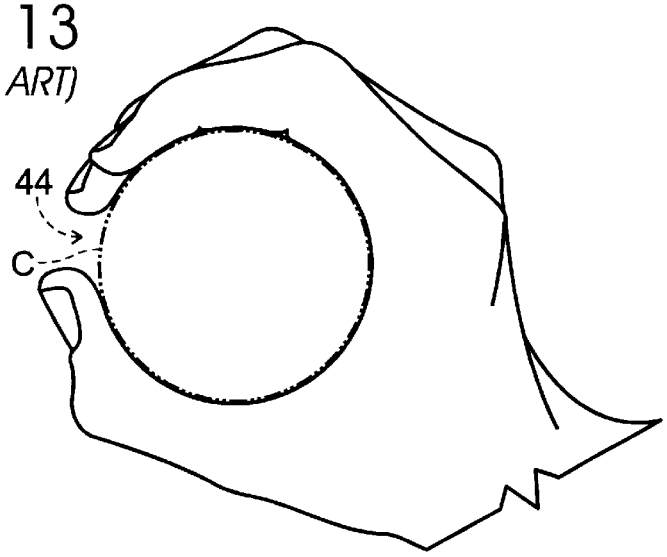
Fig. 13 (PRIOR ART)
FIG. 13 illustrates the hand of FIG. 12 gripping a radially symmetric, prior art wrench for purposes of comparison.

To appreciate the advantage provided by this configuration, FIG. 12 shows the handle end 44 being gripped by a hand. By way of comparison, FIG. 13 shows a substantially radially symmetric handle, here having a cylindrical cross-section, which has the same circumferential length "C" as for the housing 1, being gripped by a hand of the same size. In FIG. 12, the user's grip is distributed about the handle end 44 so that it retains the same amount of overall grip as that shown in FIG. 13, yet is better positioned to resist twisting of the wrench about the axis R1.

Figure 14:
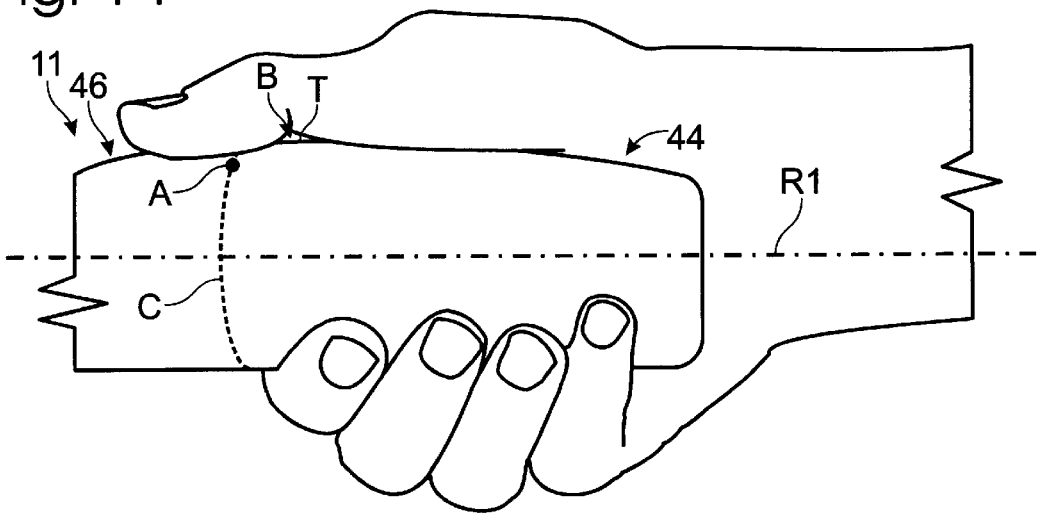
FIG. 14 illustrates a hand gripping the wrench of FIG. 7 in an alternative manner to that shown in FIG. 12.

Referring to FIG. 14, the particular shape shown in FIGS. 7, 8 and, particularly, 10 facilitates a grip wherein the thumb does not extend to meet the fingers but, rather, extends along a relatively narrow ridge portion 46 of the housing 11. The narrowness of the ridge portion 46 allows the thumb, which is relatively strong, to be used to oppose twisting of the wrench at a point where maximum torque can be applied. From the top "T" of this ridge, the thumb can be moved a minimal amount in one direction about the axis R1, such as to the point "A", or moved to a similarly situated point "B" on the opposite side of the handle end 44 (FIG. 9) as appropriate to resist twisting in a particular direction. For a given circumferential length "C" of the housing 11, the narrowness of the ridge portion 44 also gives the user at, e.g., point A as much leverage as possible about the axis "R1."

As has been discussed above and shown in FIG. 11, the housing 11 is preferably formed in two halves that are joined together by screws 48, also shown in FIG. 10; however, the housing may be formed in an alternative number of parts or may be integrally formed around the wrench mechanism without departing from the principles of the invention.

Figure 15A:
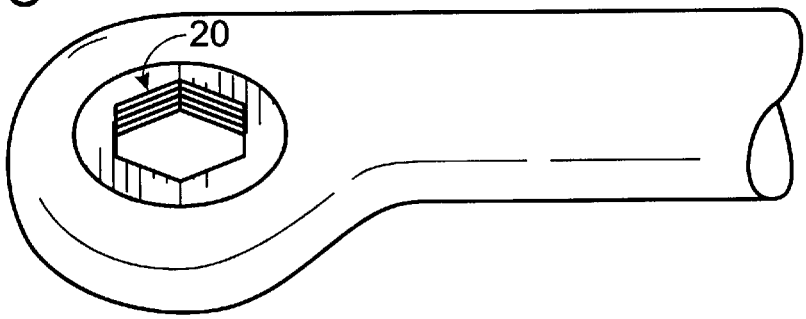
FIG. 15*a* is a perspective, partially cut away view of the low-profile wrench of FIG. 7 showing a grooved interior of a coupling feature.
Figure 15B:
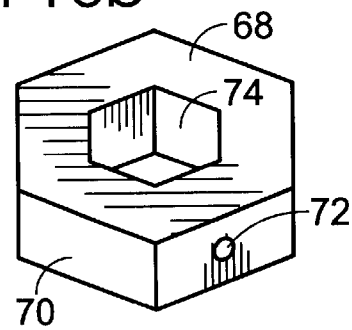
FIG. 15*b* is a perspective view of an insert for placement in the coupling feature of FIG. 15*a*.

Preferably, the coupling feature 20 is an integral part of the wrench. Accordingly, to accommodate fasteners of different sizes and shapes, a plurality of inserts 68 having different interior sizes or shapes may be provided for insertion into the coupling feature by a snap fit. As shown in FIGS. 15*a* and 15*b*, an exemplary insert 68 has an outer periphery 70 of a size and shape to fit snugly into the interior of the coupling feature 20, a spring-loaded ball 72 or other retainer for holding the insert inside the coupling feature 20, and an inner periphery 74 of a size and shape to match the outer periphery of a selected fastener. The coupling feature 20 is provided with one or more interior grooves for receiving the insert 68. Where several grooves are provided, the insert may be positioned to one side or the other of the wrench, rather than directly in the center, as needed. The insert may be provided in female form as shown, or may be provided in male form, such as a screw-driver bit. Moreover, the lateral face of the second turning member may be adapted to receive snap-in inserts without the use of a throughport, such as shown in the Begin wrench, according to some aspects of the present invention.

As an alternative to the use of snap-in inserts for the coupling feature, a plurality of turning members ma be provided for the wrench 10 in a variety of different sizes or shapes, permitting a user to substitute one coupling feature for another as required. Removal of the screws 48 permits disassembling the housing to provide access to the turning member 14 for replacement of parts therein where desired.

The torque-converter mechanism shown in FIG. 11 illustrates additional features for minimizing the lateral width of the wrench 10. In particular, the worm gear 14 includes a seat 14*a* visible in the Figure and a symmetrically disposed seat 14*b*, the seats being axially recessed with respect to a width "w" of the gear defining the lateral extent of gear teeth 60. This permits receiving bearings 62*a*, 62*b* to be flush or more nearly flush with the gear, providing for increased minimization of lateral width. The bearings contact the respective seats 14*a*, 14*b* of the gear, and corresponding seats 64*a*, 64*b* in the housing 11, and are secured to the housing 11 by respective clips 66.

Referring back to FIGS. 7 and 9, preferred embodiments of the input 13 and the housing partially surrounding the input 13 are shown. The input 13 includes a knurled cylindrical knob 50 having formed therein a square drive recess 52 for receiving a square drive from a powered driving source. As best seen in FIG. 7, the knob 50 is recessed or substantially flush along the "z" dimension (hereinafter "axially recessed") with respect to upper and lower sheaths 54 and 57 which extend to cover and thereby protect the knob 50 from above and below during use of the wrench. On the other hand, the housing 11 is relieved on its sides at the knob 50 so that a portion of the knob is laterally accessible, i.e., from directions parallel to the axis "R2." Preferably, ledges 56*a*, 56*b* on the sheaths are approximately aligned with the exterior surface 58 of the knob along lines "L" (FIG. 9), so that sliding a finger along the ledges 56 guides the finger to rotate the knob in order to align or index the coupling feature 20 to the radial orientation of the fastener.

Referring back to FIGS. 7 and 8, a bulge 60 in the housing 11 proximate the coupling feature 20 provides space inside the housing to receive portions of the wrench mechanism, e.g., the worm 16 of the turning member (FIG. 3). The bulge confines any widening of the ratchet end 42 of the housing 11 that is necessary to accommodate the space required without widening the entire ratchet end, maintaining as low a profile as possible and providing the advantage of the narrower width under some circumstances.

It is to be recognized that, while a particular low-profile wrench has been shown and described as preferred, other configurations and methods could be utilized, in addition to those already mentioned, without departing from the principles of the invention.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

What is claimed is:

1. A low-profile wrench for turning a fastener, comprising:

a first turning member having a first axis of rotation;

a second turning member having a second axis of rotation that is angled with respect to said first axis of rotation, wherein said first turning member is adapted to engage said second turning member so that turning said first turning member about said first axis of rotation turns said second turning member about said second axis of rotation said second turning member including a throughport; and an insert having an aperture that extends therethrough along an axis for a length, wherein said throughport is adapted to removably retain said insert so that said axis of said aperture is congruent with said second axis of rotation, said aperture being shaped to receive the fastener and having substantially constant lateral dimensions so as to engage the fastener throughout the length of the aperture.

2. The low-profile wrench of claim 1, further comprising a housing for substantially enclosing said first and second turning members, said housing having a handle end portion adapted for gripping the wrench by hand, wherein said first turning member includes an input end having a recess for receiving the shank of a driving tool for turning the first turning member about the first axis, wherein said handle end portion includes at least one sheath, and wherein said input end is axially recessed with respect to said at least one sheath, said at least one sheath leaving a portion of said input end laterally accessible for finger manipulation of said input end.

3. The low-profile wrench of claim 1, wherein said insert is adapted to fit substantially fully within said throughport.

4. The low-profile wrench of claim 3, wherein said first turning member comprises a worm shaft and said second turning member comprises a worm gear, and wherein a lateral face of said worm gear has a recess surrounding said throughport for receiving a ring-shaped bearing for rotationally supporting said worm gear.

5. The low-profile wrench of claim 3, further comprising a housing for substantially enclosing said first and second turning members, said housing having a handle end portion adapted for gripping the wrench by hand, wherein said first turning member includes an input end having a recess for receiving the shank of a driving tool for turning the first turning member about the first axis, wherein said handle end portion includes at least one sheath, and wherein said input end is axially recessed with respect to said at least one sheath said at least one sheath, leaving a portion of said input end laterally accessible for finger manipulation of said input end.

6. The low-profile wrench of claim 1, wherein said first turning member comprises a worm shaft and said second turning member comprises a worm gear, and wherein a lateral face of said worm gear has a recess surrounding said throughport for receiving a ring-shaped bearing for rotationally supporting said worm gear.

7. The low-profile wrench of claim 6, wherein said insert is adapted to fit substantially fully within said throughport.

8. The low-profile wrench of claim 7, further comprising a housing for substantially enclosing said first and second turning members, said housing having a handle end portion adapted for gripping the wrench by hand, wherein said first turning member includes an input end having a recess for receiving the shank of a driving tool for turning the first turning member about the first axis, wherein said handle end portion includes at least one sheath, and wherein said input end is axially recessed with respect to said at least one sheath said at least one sheath, leaving a portion of said input end laterally accessible for finger manipulation of said input end.

9. A low-profile wrench for turning a fastener, comprising:

a first turning member having a first axis of rotation;

a second turning member having a second axis of rotation that is angled with respect to said first axis of rotation, wherein said first turning member is adapted to engage said second turning member so that turning said first turning member about said first axis of rotation turns said second turning member about said second axis of rotation, said second turning member including a throughport; and an insert having an aperture, wherein said throughport is adapted to removably retain said insert so that said insert fits substantially fully within said wrench so as to minimize the width of the wrench, and wherein said aperture of said insert is shaped to receive the fastener.

10. The low-profile wrench of claim 9, wherein said first turning member comprises a worm shaft and said second turning member comprises a worm gear, and wherein a lateral face of said worm gear has a recess surrounding said throughport for receiving a ring-shaped bearing for rotationally supporting said worm gear.

11. The low-profile wrench of claim 10, further comprising a housing for substantially enclosing said first and second turning members, said housing having a handle end portion adapted for gripping the wrench by hand, wherein said first lurking member includes an input end having a recess for receiving the shank of a driving tool for turning the first turning member about the first axis, wherein said handle end portion includes at least one sheath, and wherein said input end is axially recessed with respect to said at least one sheath, said at least one sheath leaving a portion of said input end laterally accessible for finger manipulation of said input end.

12. The low-profile wrench of claim 9, further comprising a housing for substantially enclosing said first and second turning members, said housing having a handle end portion adapted for gripping the wrench by hand, wherein said first turning member includes an input end having a recess for receiving the shank of a driving tool for turning the first turning member about the first axis, wherein said handle end portion includes at least one sheath, and wherein said input end is axially recessed with respect to said at least one sheath, said at least one sheath leaving a portion of said input end laterally accessible for finger manipulation of said input end.

13. A low-profile wrench for turning a fastener, comprising:

a first turning member having a first axis of rotation;

a second turning member having a second axis of rotation that is angled with respect to said first axis of rotation, wherein said first turning member is adapted to engage said second turning member so that turning said first turning member about said first axis of rotation turns said second turning member about said second axis of rotation, said second turning member including a throughport; and an insert having an aperture that extends therethrough along an axis, wherein said throughport is adapted to removably retain said insert so that said axis of said aperture is congruent with said second axis of rotation, said aperture being shaped to receive the fastener and having substantially constant lateral dimensions, said insert being adapted to fit substantially fully within said throughport so as to minimize the width of the wrench.

14. A low-profile wrench for turning a fastener, comprising:

a first turning member having a first axis of rotation;

a second turning member having a second axis of rotation that is angled with respect to said first axis of rotation, wherein said first turning member is adapted to engage said second turning member so that turning said first turning member about said first axis of rotation turns said second turning member about said second axis of rotation, said second turning member including a throughport; and an insert having an aperture that extends therethrough along an axis so as to allow the fastener to pass through the insert, wherein said throughport is adapted to removably retain said insert so that said axis of said aperture is congruent with said second axis of rotation, said aperture being shaped to receive the fastener and having substantially constant minimum lateral dimensions for a length thereof so as to engage the fastener throughout said length of the aperture.

* * * * *

UNITED STATES PATENT AND TRADEMARK OFFICE
Certificate

Patent No. 6,536,310 B2 Patented: March 25, 2003

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Nathan Goldfein, Phoenix, AZ; and Eric E. Christian, Albuquerque, NM.

Signed and Sealed this Thirtieth Day of December 2003.

JOSEPH J. HAIL, III
*Supervisory Patent Examiner*
*Art Unit 3723*

UNITED STATES PATENT AND TRADEMARK OFFICE

CERTIFICATE OF CORRECTION

PATENT NO. : 6,536,310 B2
DATED : March 25, 2003
INVENTOR(S) : Nathan Goldfein et al.

It is certified that error appears in the above-identified patent and that said Letters Patent is hereby corrected as shown below:

Column 8,
Lines 9 and 28, delete “one sheath” and replace with -- one sheath, --;
Lines 10 and 29, delete “sheath, leaving” and replace with -- sheath leaving --;
Line 56, delete “first lurking member” and replace with -- first turning member --.

Signed and Sealed this

Twenty-sixth Day of July, 2005

JON W. DUDAS
*Director of the United States Patent and Trademark Office*